US010648066B2

(12) United States Patent
Kamat et al.

(10) Patent No.: US 10,648,066 B2
(45) Date of Patent: May 12, 2020

(54) REDUCED AGING TIME OF 7XXX SERIES ALLOY

(71) Applicant: NOVELIS INC., Atlanta, GA (US)

(72) Inventors: Rajeev G. Kamat, Marietta, GA (US); Hashem Mousavi-Anijdan, Kennesaw, GA (US); Rahul Kulkarni, Marietta, GA (US); Mario A. Salgado-Ordorica, Sion (CH)

(73) Assignee: NOVELIS INC., Atlanta, GA (US)

( * ) Notice: Subject to any disclaimer, the term of this patent is extended or adjusted under 35 U.S.C. 154(b) by 1052 days.

(21) Appl. No.: 14/963,318

(22) Filed: Dec. 9, 2015

(65) Prior Publication Data

US 2016/0160332 A1 Jun. 9, 2016

Related U.S. Application Data

(60) Provisional application No. 62/089,288, filed on Dec. 9, 2014.

(51) Int. Cl.

| | |
|---|---|
| ***C22F 1/04*** | (2006.01) |
| ***C21D 9/46*** | (2006.01) |
| ***C22F 1/00*** | (2006.01) |
| ***C21D 9/00*** | (2006.01) |
| ***C22F 1/053*** | (2006.01) |

(52) U.S. Cl.

CPC ..... *C22F 1/04* (2013.01); *C21D 9/0068* (2013.01); *C21D 9/46* (2013.01); *C22F 1/002* (2013.01); *C22F 1/053* (2013.01)

(58) Field of Classification Search

CPC . C22F 1/04; C22F 1/002; C22F 1/053; C21D 9/0068; C21D 9/46

USPC ..... 148/698

See application file for complete search history.

(56) References Cited

U.S. PATENT DOCUMENTS

| | | | | |
|---|---|---|---|---|
| 4,196,021 | A | 4/1980 | Bouvaist et al. | |
| 4,629,517 | A | 12/1986 | Lifka et al. | |
| 6,679,958 | B1 | 1/2004 | Tundal et al. | |
| 2003/0041934 | A1* | 3/2003 | Lumley | C22F 1/04 148/698 |
| 2004/0089378 | A1 | 5/2004 | Senkov et al. | |
| 2010/0224293 | A1 | 9/2010 | Wang et al. | |
| 2011/0203343 | A1 | 8/2011 | Bouchet et al. | |

(Continued)

FOREIGN PATENT DOCUMENTS

| | | | |
|---|---|---|---|
| CN | 102459673 | A | 5/2012 |
| CN | 102676962 | A | 9/2012 |
| CN | 102978544 | A | 3/2013 |

(Continued)

OTHER PUBLICATIONS

European Application No. 15812925.4 , "Communication pursuant to Article 94(3) EPC", Jul. 4, 2018, 4 pages.

(Continued)

*Primary Examiner* — Brian D Walck

(74) *Attorney, Agent, or Firm* — Kilpatrick Townsend & Stockton LLP

(57) ABSTRACT

The present invention relates to the reduction of artificial aging time of 7xxx series alloys. Currently, the artificial aging times for typical 7xxx series alloy can be as long as 24 hrs. The current invention allows for a significant reduction of aging times, thereby saving time, energy, money and storage space hence increasing the productivity.

18 Claims, 16 Drawing Sheets

(56) References Cited

U.S. PATENT DOCUMENTS

| | | | |
|---|---|---|---|
| 2015/0101718 | A1 | 4/2015 | Harrison et al. |
| 2015/0218679 | A1 | 8/2015 | Aruga et al. |

FOREIGN PATENT DOCUMENTS

| | | | |
|---|---|---|---|
| CN | 103103424 | A | 5/2013 |
| CN | 103540875 | A | 1/2014 |
| EP | 0412204 | A1 | 2/1991 |
| EP | 2581218 | A1 | 4/2013 |
| JP | 09256129 | | 9/1997 |
| JP | 2014062283 | | 4/2014 |
| JP | 2014062287 | | 4/2014 |

OTHER PUBLICATIONS

Japanese Patent Application No. 2017-547932, "Office Action", dated Jun. 5, 2018, 15 pages.
Nin, Ai-Lin et al., "Microstructure and Mechanical Properties of 7A04 Aluminum Alloy in Higher Temperature Solid Solution," Light Alloy Fabrication Technology, vol. 33, No. 5, pp. 48-51 (2005).
Mu, Yesheng, "Application of Novel Industrial Materials," May 1, 1985, pp. 36-38.
Chinese Patent Application No. CN 201580066746.5, Office Action dated May 2, 2018, 24 pages.
Berg, L. K., et al., "GP-Zones in Al—Zn—Mg Alloys and Their Role in Artificial Aging", Acta mater., 2001, pp. 3443-3451, vol. 49, Elsevier Science Ltd.
Chen, Xu, et al., "Enhanced Fatigue Crack Propagation Resistance in an Al—Zn—Mg—Cu Alloy by Retrogression and Reaging Treatment," Journal of Materials Engineering and Performance, Feb. 15, 2012, pp. 2345-2353, vol. 21, No. 11, ASM International.
Emani, S. V., et al., "Double aging and thermomechanical heat treatment of AA7075 aluminum alloy extrusions", J Mater Sci., Sep. 22, 2009, 8 pages, Springer Science+Business Media, LLC.
Katz, Z., et al., "Precipitation Kinetics in Al-alloys", Scripta Metallurgica, Mar. 1981, pp. 265-268, vol. 15, Issue 3, Pergamon Press Ltd.
Marlaud, T., et al., "Evolution of precipitate microstructures during the retrogression and re-ageing heat treatment of an Al—Zn—Mg—Cu alloy", Acta Materialia, Aug. 1, 2010, pp. 4814-4826, vol. 58, Issue 14, Elsevier.
Stiller, K., et al., "Investigation of precipitation in an Al—Zn—Mg alloy after two-step ageing treatment at 100° and 150°C", Materials Science and Engineering A270, 1999, pp. 55-63, Elsevier Science S.A.
International Patent Application No. PCT/US2015/064597, International Search Report and Written Opinion dated Feb. 17, 2016, 14 pages.
International Patent Application No. PCT/US2015/064597, International Preliminary Report on Patentability dated Jun. 22, 2017, 9 pages.
International Patent Application No. PCT/US2015/064597, International Search Report and Written Opinion dated Apr. 13, 2016, 14 pages.
Canadian Application No. 2,967,464 , "Office Action", dated Sep. 17, 2018, 3 pages.
Cayless et al., "Alloy and Temper Designation Systems for Aluminum and Aluminum Alloys Wrought Aluminum and Aluminum Alloy Designation System", Properties and Selection: Nonferrous Alloys and Special-Purpose Materials, vol. 2, Dec. 31, 1990, pp. 15-28.
Chinese Application No. 201580066746.5, "Office Action", dated Oct. 15, 2018, 14 pages.
European Application No. 15812925.4 , "Office Action", dated Nov. 7, 2018, 5 pages.
Japanese Application No. 2017-547932 , "Office Action", dated Oct. 30, 2018, 6 pages.
Korean Application No. 10-2017-7018729 , "Office Action", dated Aug. 14, 2018, 14 pages.
Canadian Application No. 2,967,464 , "Notice of Allowance", dated Jun. 25, 2019, 1 page.
European Application No. 15812925.4 "Office Action", dated Mar. 22, 2019, 3 pages.
Japanese Application No. 2017-547932, "Notice of Decision to Grant", dated Jan. 22, 2019, 3 pages.
Korean Application No. 10-2017-7018729, "Office Action", dated Feb. 25, 2019, 5 pages.
Chinese Application No. 201580066746.5, "Office Action", dated Apr. 4, 2019, 16 pages.
Korean Application No. 10-2017-7018729, "Notice of Decision to Grant", dated May 9, 2019, 2 pages.
European Application No. 15812925.4 , "Notice of Decision to Grant", dated Nov. 7, 2019, 2 pages.
Chinese Application No. 201580066746.5 , "Notice of Decision to Grant", dated Jul. 26, 2019, 7 pages.

* cited by examiner

| | Time (hr) | Immediately-in W-temper | One day of natural aging-in T6 | Two days of natural aging-in T4 | One Week of natural aging | | Two Weeks of natural aging-in T4 |
|---|---|---|---|---|---|---|---|
| | | | | | in T4 | in T6 | |
| 70° C | 1 | Y.S. = 325.7<br>EL=23.7 | | Y.S. = 340.1<br>EL=26.3 | Y.S. = 354.9<br>EL=23.4 | | Y.S. = 359.5<br>EL=22.6 |
| | 6 | N/A | Y.S. = 520.5<br>EL=15.8 | Y.S. = 364.4<br>EL=22.2 | Y.S. = 373.8<br>EL=25.1 | Y.S. = 519.2<br>EL=15.3 | Y.S. = 374.9<br>EL=22.9 |
| 100° C | 1 | Y.S. = 360.4<br>EL=23.6 | | Y.S. = 364.9<br>EL=22.6 | Y.S. = 372.3<br>EL=19.9 | | Y.S. = 378<br>EL=22.2 |
| | 6 | N/A | Y.S. = 525.2<br>EL=15 | Y.S. = 425.6<br>EL=19.9 | Y.S. = 431.2<br>EL=20.3 | Y.S. = 524.5<br>EL=14.9 | Y.S. = 431.9<br>EL=20.5 |
| 110° C | 1 | Y.S. = 372.3<br>EL=21.9 | | Y.S. = 380.9<br>EL=22.6 | Y.S. = 384.3<br>EL=22.8 | | Y.S. = 389.9<br>EL=20.8 |
| | 6 | N/A | | Y.S. = 448.6<br>EL=18.7 | Y.S. = 450.2<br>EL=19.1 | | Y.S. = 449.9<br>EL=18.6 |
| 125° C | 1 | Y.S. = 396<br>EL=21.1 | | Y.S. = 402.4<br>EL=19 | Y.S. = 408.4<br>EL=19.7 | | Y.S. = 409.9<br>EL=19.4 |
| | 6 | N/A | Y.S. = 528.2<br>EL=14.4 | Y.S. = 487.8<br>EL=16.3 | Y.S. = 489.5<br>EL=16.2 | Y.S. = 524.9<br>EL=14.6 | Y.S. = 490.8<br>EL=15.6 |

FIGURE 1

| | Second Step Temp. | 150° C | | 175° C | | 180° C (Paint Bake) |
|---|---|---|---|---|---|---|
| First Step Temp. | Time (hr) | 1 | 6 | 1 | 6 | 30 min |
| 70° C | 1 | Y.S. = 467 | Y.S. = 471 | Y.S. = 460 | Y.S. = 497 | |
| | 6 | Y.S. = 476<br>EL = 16.3 | Y.S. = 504<br>EL = 13 | Y.S. = 497<br>EL = 12.4 | Y.S. = 477<br>EL = 11.6 | Y.S. = 487<br>EL = 13.3 |
| 100° C | 1 | Y.S. = 470<br>EL = 15.5 | Y.S. = 509<br>EL = 12.3 | Y.S. = 497<br>EL = 12.7 | Y.S. = 472<br>EL = 11.3 | Y.S. = 493<br>EL = 12.4 |
| | 6 | Y.S. = 475 | Y.S. = 517<br>EL = 13.3 | Y.S. = 505<br>EL = 12.3 | Y.S. = 486<br>EL = 11.7 | |
| 110° C | 6 | | | | | Y.S. = 507<br>13.8 |
| 120° C | 1 | Y.S. = 476<br>EL = 14.7 | Y.S. = 511<br>EL = 12.6 | Y.S. = 496<br>EL = 12.8 | Y.S. = 481<br>EL = 11.7 | Y.S. = 498<br>EL = 12.5 |
| | 6 | Y.S. = 485 | Y.S. = 513 | Y.S. = 502 | Y.S. = 494 | |
| 125° C | 6 | | | | | Y.S. = 503<br>EL = 12.8 |

FIGURE 2

REDUCED AGING TIME OF 7XXX SERIES ALLOY

FIELD OF THE INVENTION

The present invention provides methods to reduce the artificial aging time of 7xxx series alloys. Currently, the artificial aging times for typical 7xxx series alloys can be as long as 24 hrs. The current invention allows for a significant reduction of aging times and increase in productivity to achieve desired properties of strength and elongation, thereby saving energy, time and money.

BACKGROUND

Traditionally automotive body structures have been predominantly made of steel sheet. However, more recently there has been a trend in the automotive industry to replace the heavier steel sheets with lighter aluminum sheets.

In order to be acceptable for automobile body sheet, however, an aluminum alloy must not only possess requisite characteristics of strength and corrosion resistance, for example, but also must exhibit good ductility and toughness.

Most of the aluminum alloys used in the automotive industry have been the aluminum-magnesium, or 5xxx series, and the aluminum-magnesium-silicon, or 6xxx series, alloys. While the automotive industry has seen the advent of high strength and ultra-high strength steels used for automobile construction, the 5xxx and 6xxx series alloys have reached their strength potential. Aluminum-zinc, or 7xxx series, alloys, however, offer significantly higher strengths than the 5xxx or 6xxx alloys thus making them excellent candidates to replace high strength steels. One of the disadvantages of 7xxx series alloys is the excessively long artificial aging time (up to 24 hours or longer) needed to achieve peak strengths. By contrast, the automotive industry is familiar with paint baking times which are typically less than 30 mins. In order to successfully implement the 7xxx series alloys into the automotive industry there is a need to reduce the artificial aging times.

Therefore, there is a need for improved methods to make 7xxx alloys which achieve desired properties of strength and ductility while reducing aging time, energy and cost.

SUMMARY OF THE INVENTION

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

The present invention solves the problems in the prior art and provides methods to reduce the artificial aging time of 7xxx series alloys. Currently, artificial aging times for a typical 7xxx series alloy can be as long as 24 hrs. The current invention allows for a significant reduction of aging times and saves energy, time, money, and factory and warehouse storage space for coils of 7xxx alloys or the formed parts.

The present invention also provides the benefit of achieving desired strength while maintaining the desired elongation after subjecting the sheet to paint bake conditions of about 180° C. for about 30 minutes.

The present invention provides optimal temperatures and times for reducing the duration of artificial aging of 7xxx series alloys. Different temperatures, durations of exposure to these temperatures, and numbers of heating steps are presented to achieve reduced artificial aging time while attaining desired mechanical properties of strength and ductility.

In one embodiment, a one-step aging process is used to attain the desired mechanical properties with a short aging time.

In another embodiment a two-step aging process is used to attain the desired mechanical properties with short aging times.

In still another embodiment a three-step aging process is used to attain the desired mechanical properties with short aging times.

The present invention reduces the aging time from about 24 hrs., which is employed currently, to less than 4 hrs. or less than 2 hrs. for 7xxx series alloys. The excessively long artificial aging times currently used reduce efficiency and yield in the production of 7xxx series alloys, increase the energy consumption required to produce the 7xxx series alloys, and require more floor space to be occupied by coils or automotive stamped parts of naturally aging 7xxx series alloys. Additionally, typical pre-aging practices lead to a notable increase in yield strength. The present invention results in significantly increased strength after the pre-aging, particularly within the first week after solution heat treatment, together with paint bake operations commonly used in the automotive process chain.

In embodiments, in automotive applications the paint baking step can be incorporated as the second or third artificial aging step to reduce the overall aging cycle time.

The invention can significantly reduce the aging cycle time for 7xxx sheet. This translates into higher productivity and reduced energy usage during manufacture. The invention can also be used by customers to reduce the aging cycle times which is of special interest to manufacturers in various aspects of the transportation industry, including but not limited to manufacturers of automobiles, trucks, motorcycles, planes, spacecraft, bicycles, railroad cars, and ships. The present invention has particular applicability to the automotive industry.

BRIEF DESCRIPTION OF THE FIGURES

FIG. 1 shows the effect of a single heating step at defined durations and temperatures followed by natural aging at room temperature on yield strength (Y.S. in MPa) and elongation (EL %).

FIG. 2 shows the double aging response on yield strength (Y.S. in MPa) and elongation (EL %) after two-step heating at defined durations and temperatures.

followed by a second heating step of 150° C. for 1 hr. or 6 hrs. or 175° C. for 1 hr. or 6 hrs. Effects on yield strength and elongation are shown.

Figure 6:
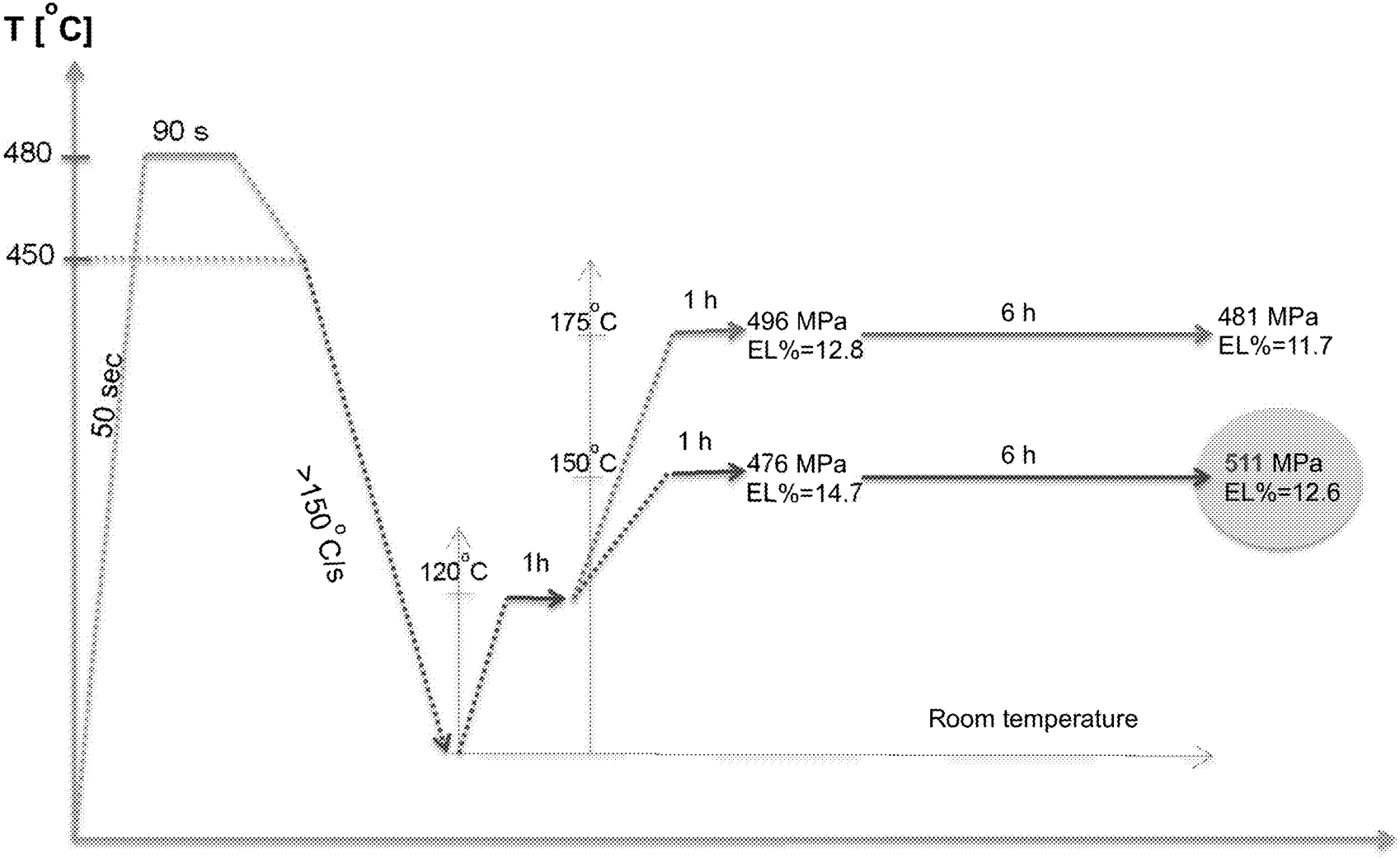

FIG. 6 is a schematic representation of a two-step aging process with the first heating step of 120° C. for 1 hr. followed by a second heating step of 150° C. for 1 hr. or 6 hrs. or 175° C. for 1 hr. or 6 hrs. Effects on yield strength and elongation are shown.

Figure 7:
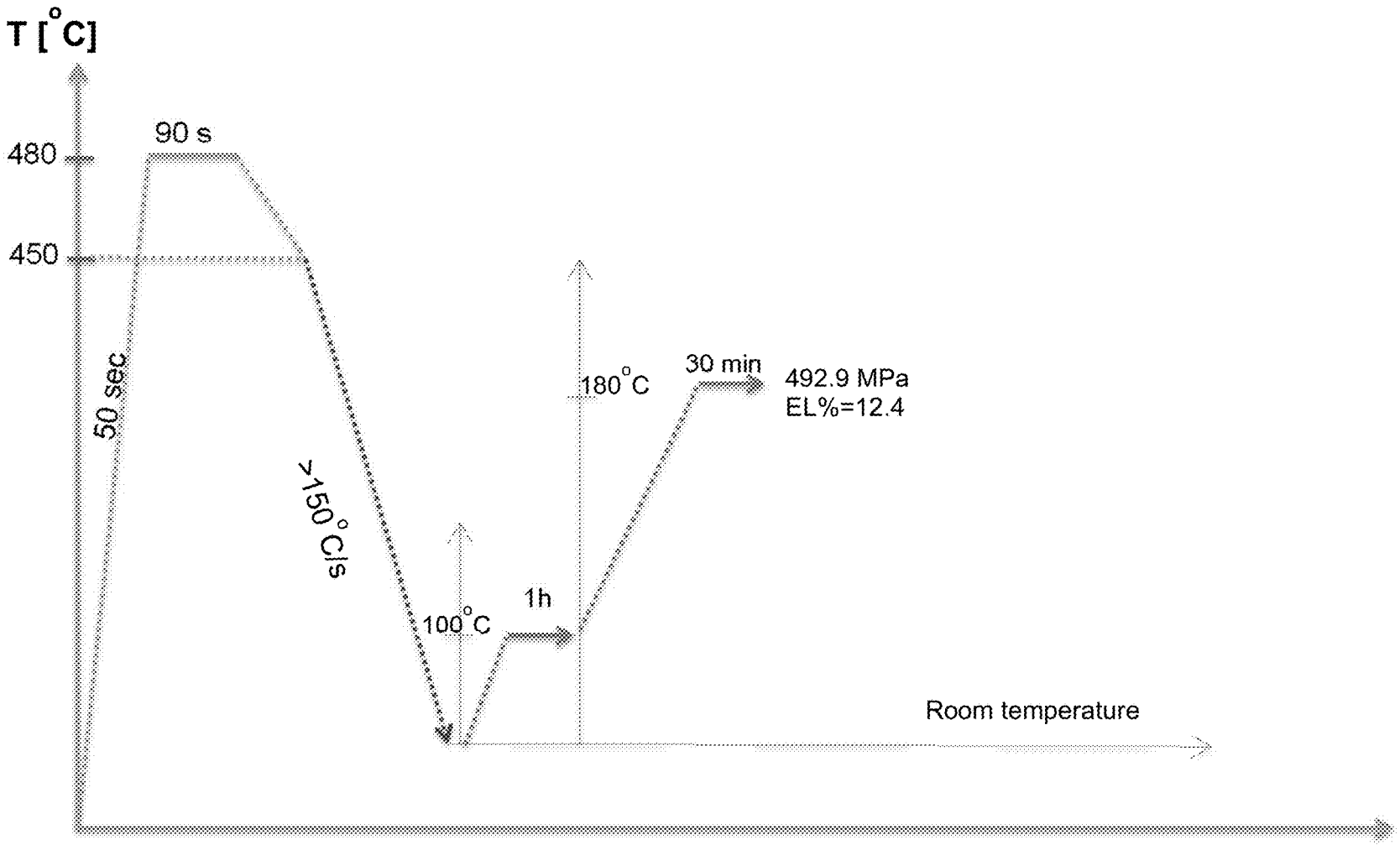

FIG. 7 is a schematic representation of a two-step aging process with the first heating step of 100° C. for 1 hr. followed by a second heating step of 180° C. for 30 min which is a conventional paint bake condition. Effects on yield strength and elongation are shown.

Figure 8:
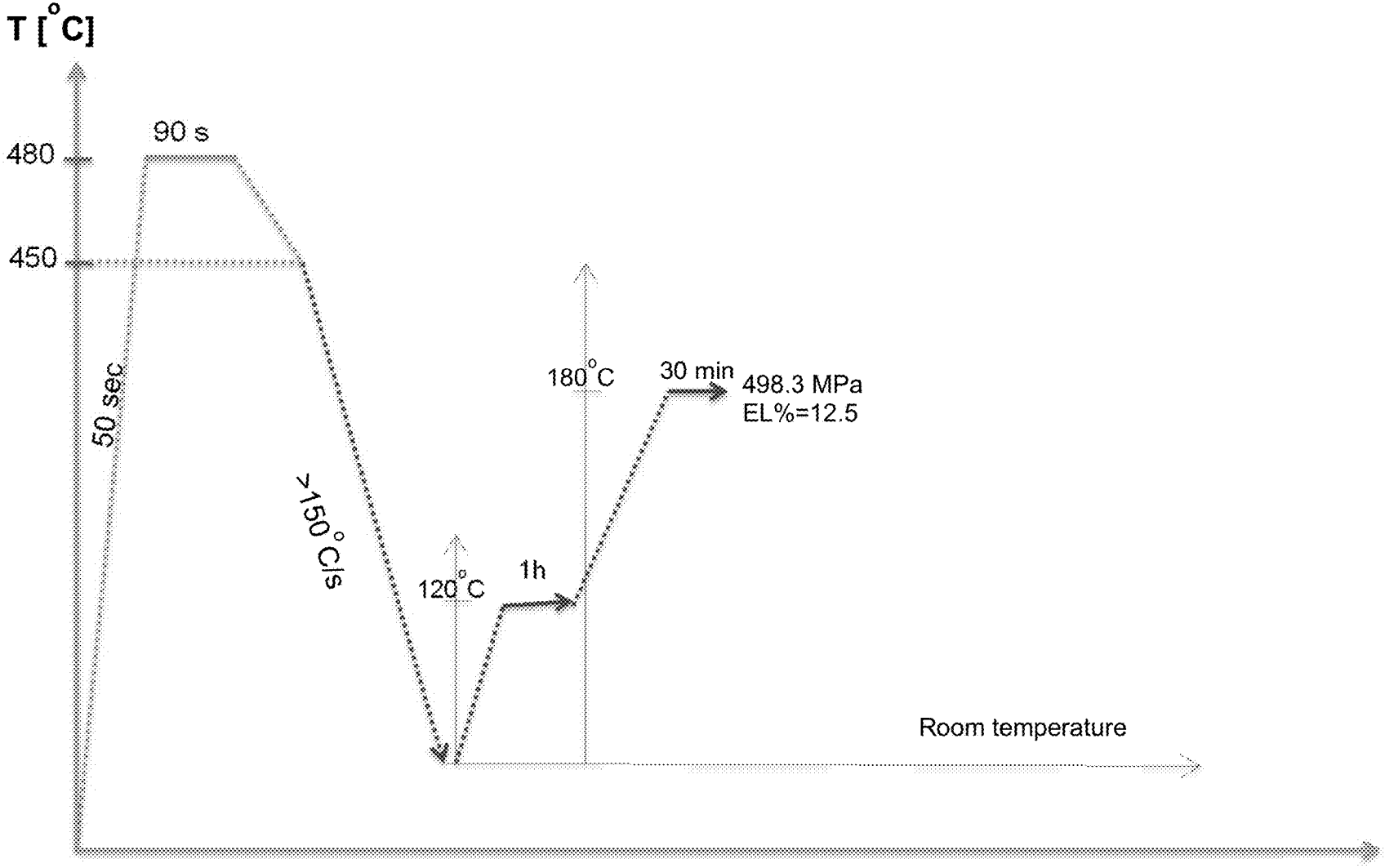

FIG. 8 is a schematic representation of a two-step aging process with the first heating step of 120° C. for 1 hr. followed by a second heating step of 180° C. for 30 min which is a conventional paint bake condition. Effects on yield strength and elongation are shown.

Figure 9:
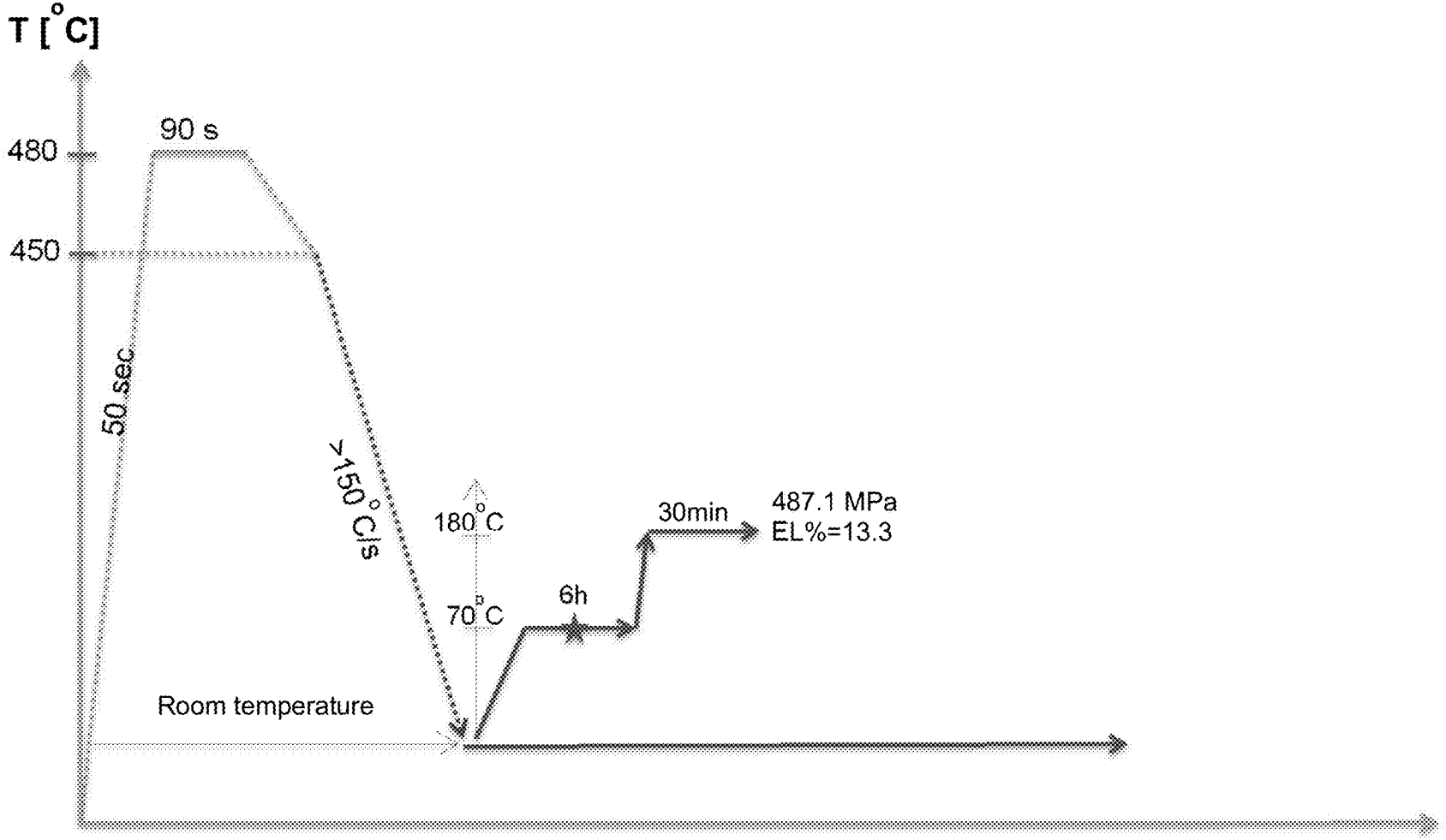

FIG. 9 is a schematic representation of a two-step aging process with the first heating step of 70° C. for 6 hrs. followed by a second heating step of 180° C. for 30 min which is a conventional paint bake condition. Effects on yield strength and elongation are shown.

Figure 10:
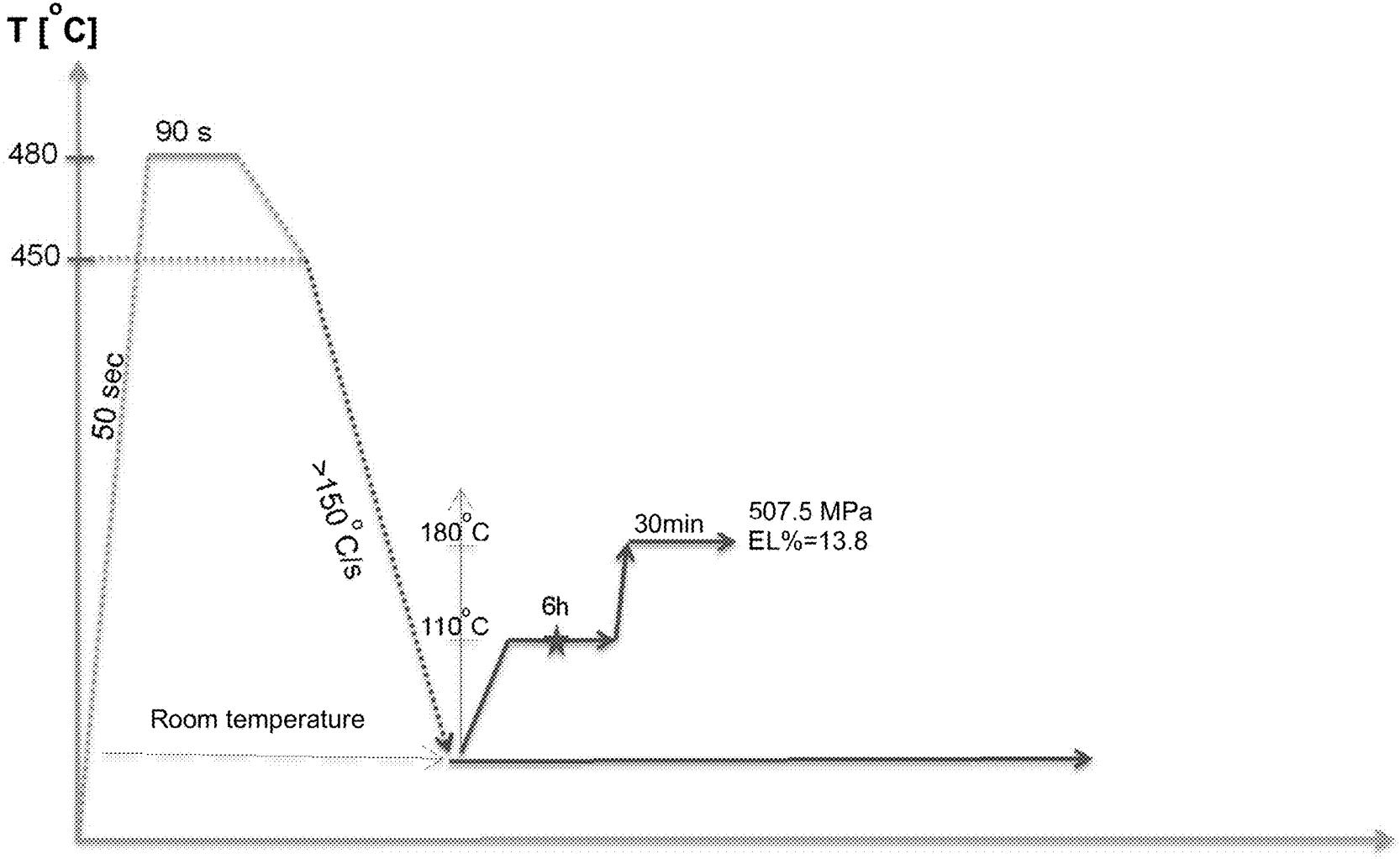

FIG. 10 is a schematic representation of a two-step aging process with the first heating step of 110° C. for 6 hrs. followed by a second heating step of 180° C. for 30 min which is a conventional paint bake condition. Effects on yield strength and elongation are shown.

Figure 11:
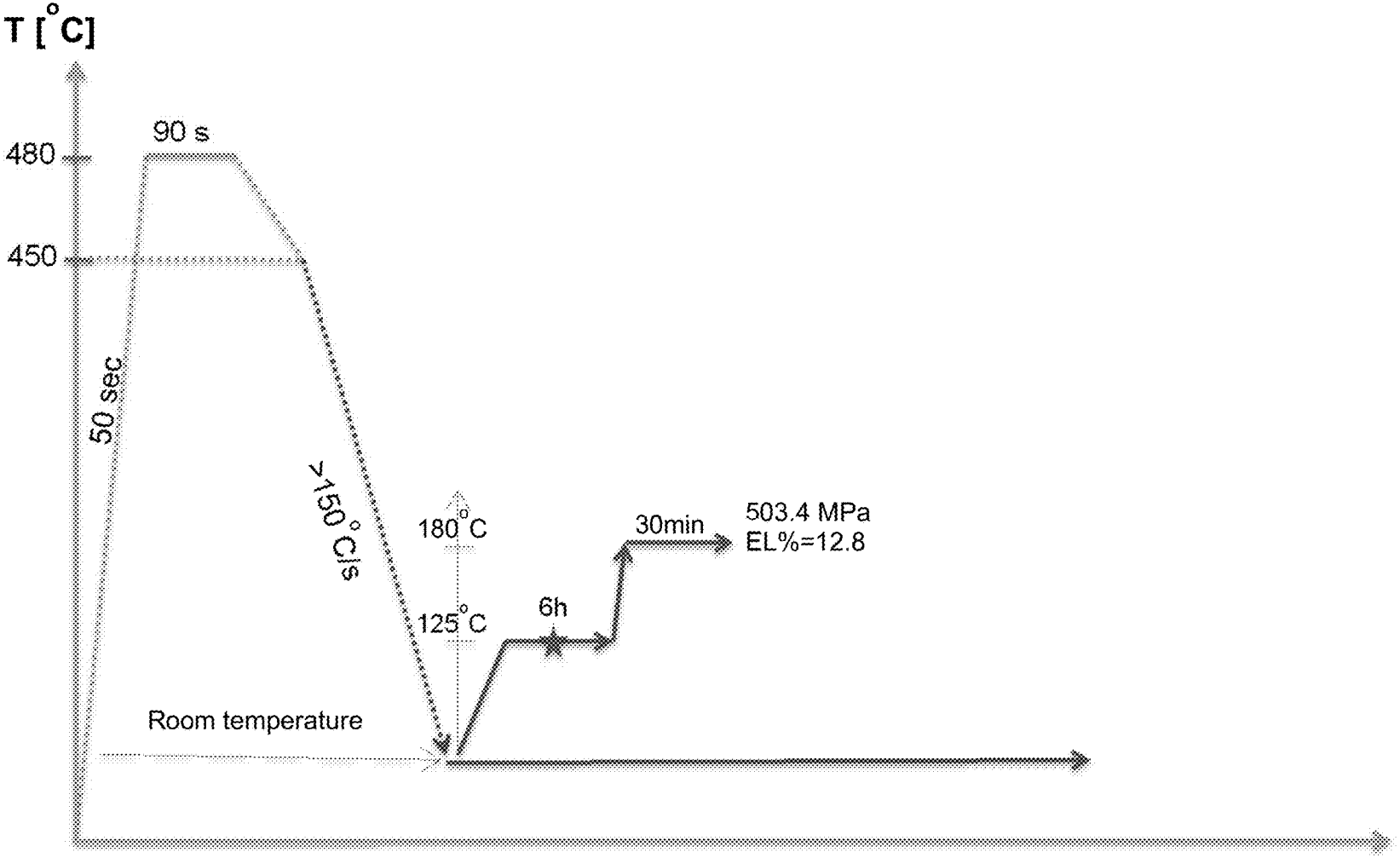

FIG. 11 is a schematic representation of a two-step aging process with the first heating step of 125° C. for 6 hrs. followed by a second heating step of 180° C. for 30 min which is a conventional paint bake condition. Effects on yield strength and elongation are shown.

Figure 12:
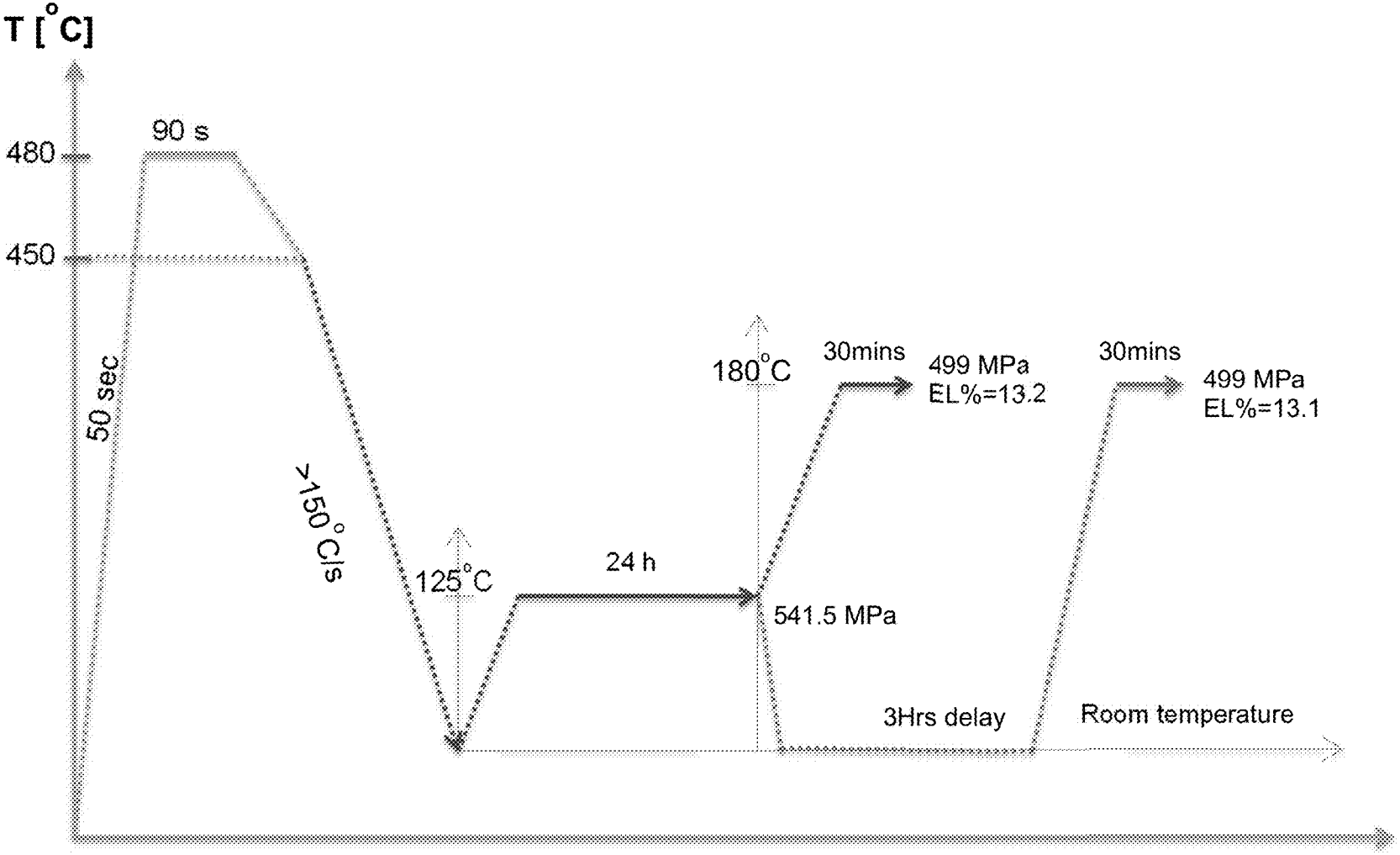

FIG. 12 is a schematic representation of a two-step aging process with the first heating step of 125° C. for 24 hrs. (the T6 condition) followed by a second heating step of 180° C. for 30 min which is a conventional paint bake condition. The second heating step occurred right after the first step or 3 hrs. later. Effects on yield strength and elongation are shown. Properties were measured at room temperature.

Figure 13:
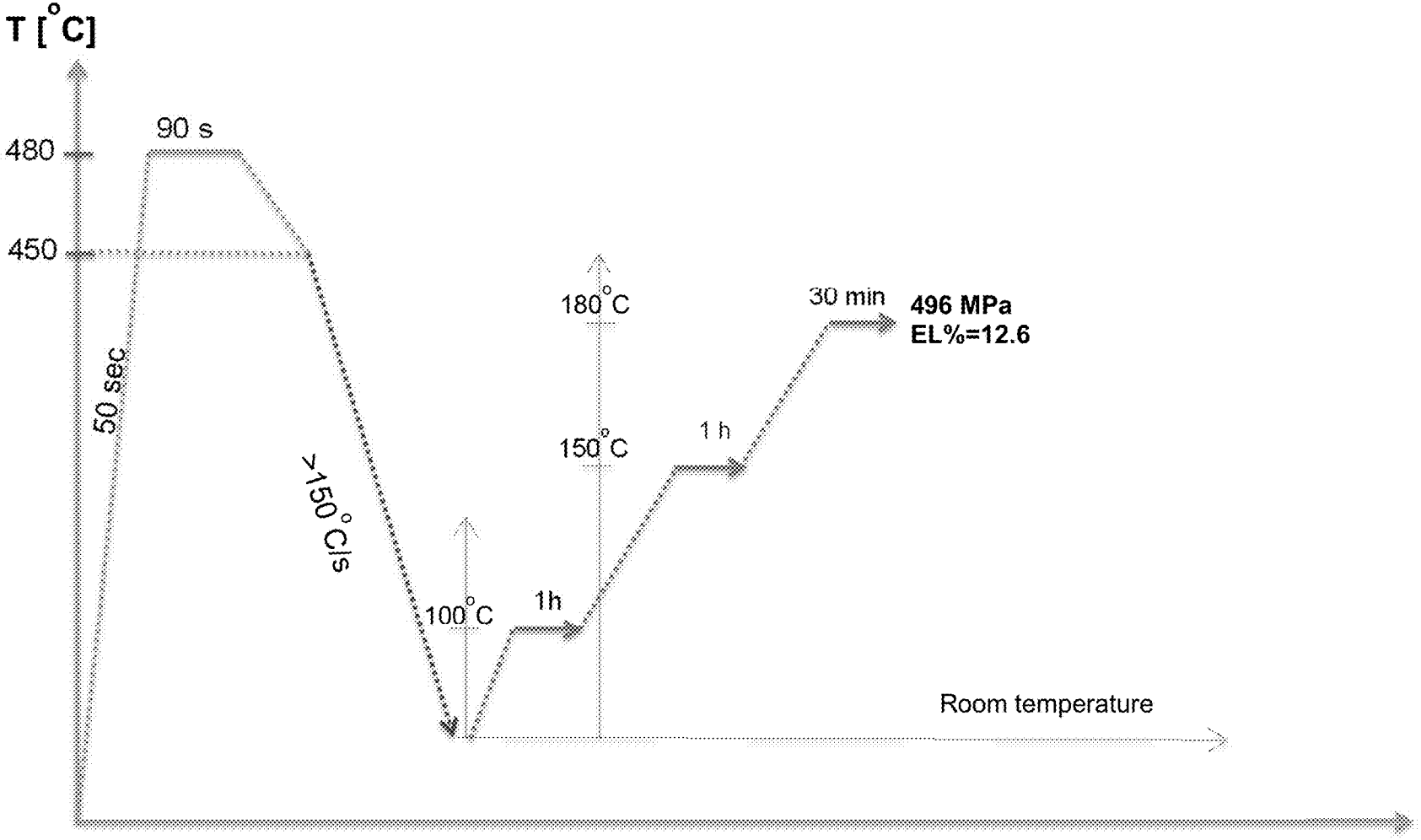

FIG. 13 is a schematic representation of a three-step aging process with the first heating step of 100° C. for 1 hr., followed by a second heating step of 150° C. for 1 hr., and a third heating step of 180° C. for 30 min which is a conventional paint bake condition. Effects on yield strength and elongation are shown.

Figure 14:
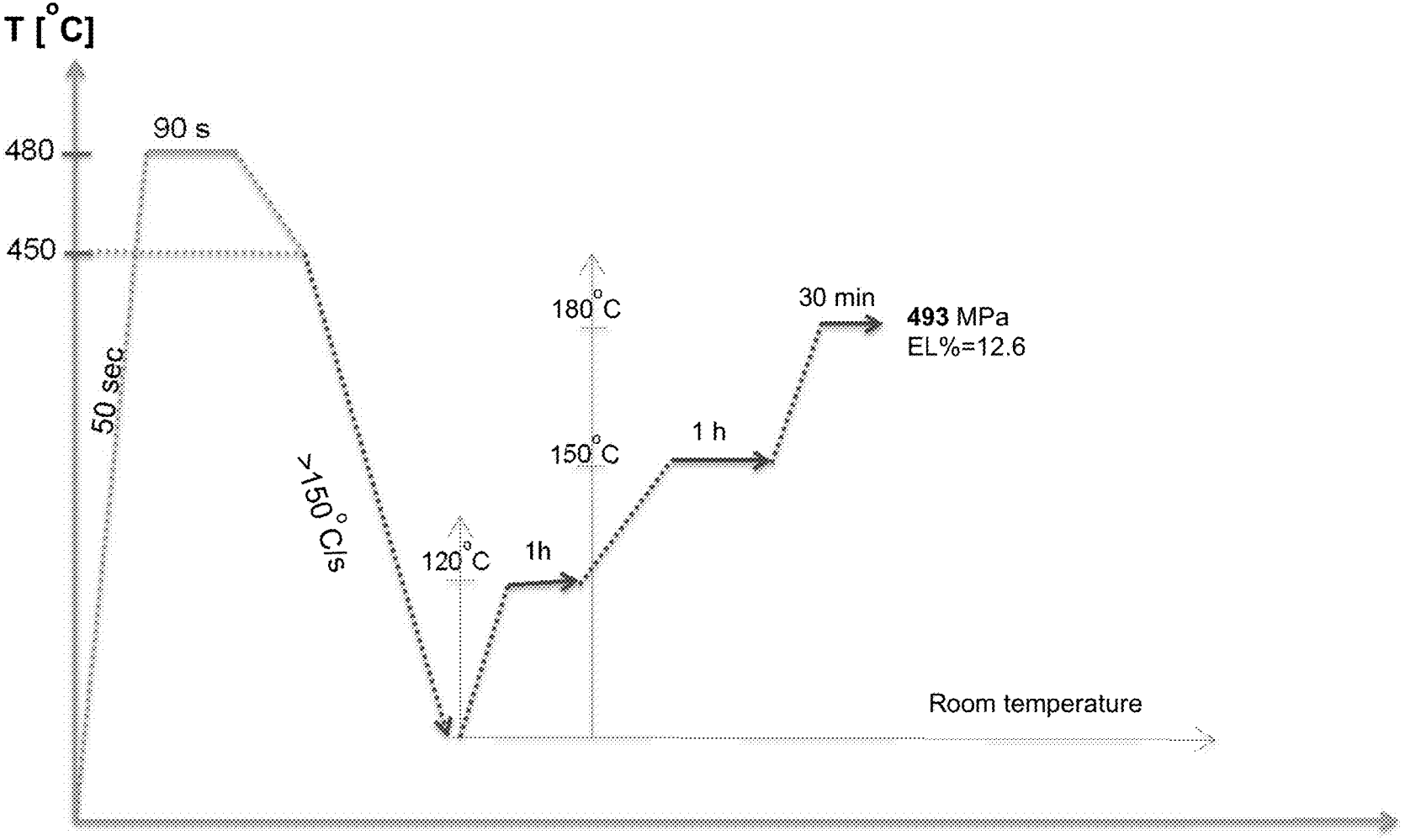

FIG. 14 is a schematic representation of a three-step aging process with the first heating step of 120° C. for 1 hr., followed by a second heating step of 150° C. for 1 hr., and a third heating step of 180° C. for 30 min which is a conventional paint bake condition. Effects on yield strength and elongation are shown.

Figure 15:
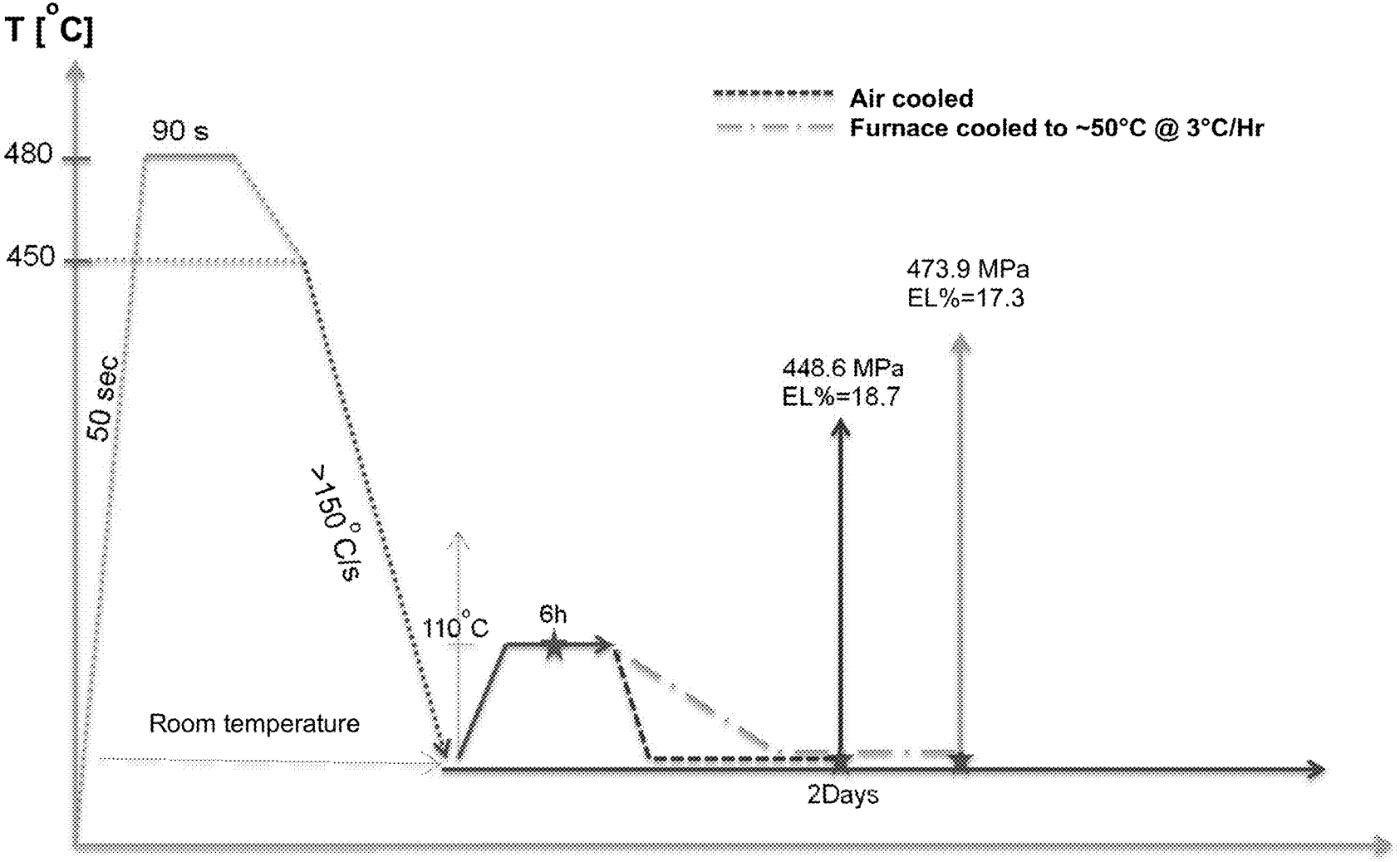

FIG. 15 is a schematic representation of a one-step aging process with the first heating step of 110° C. for 6 hr., followed by air cooling to room temperature (- - - - lines) or cooling at a rate of 3° C. per hr. to a target temperature of 50° C. (--•--•-- lines). Effects on yield strength and elongation in T4 condition are shown.

Figure 16:
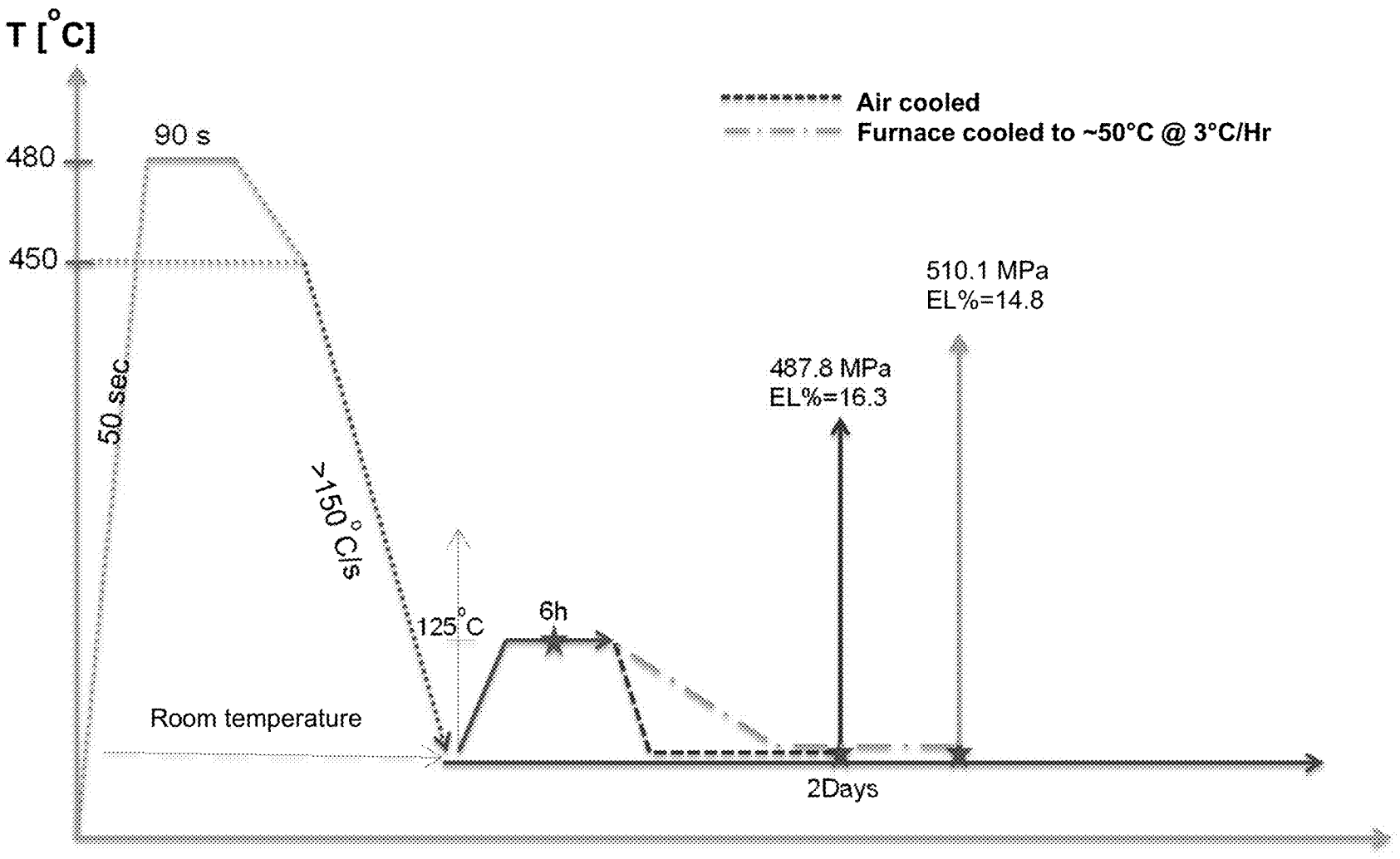

FIG. 16 is a schematic representation of a one-step aging process with the first heating step of 125° C. for 6 hr., followed by air cooling to room temperature (- - - - lines) or cooling at a rate of 3° C. per hr. to a target temperature of 50° C. (--•--•-- lines). Effects on yield strength and elongation in T4 condition are shown.

DETAILED DESCRIPTION OF THE INVENTION

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

The present invention provides a process for treating 7xxx alloys to accelerate aging and attain desired strength and ductility. In some embodiments, following solution heat treatment (SHT), 7xxx alloy sheets are heated in one aging step to a temperature ranging from 130° C. to 150° C. for a duration of 1 to 5 hrs. In other embodiments, following SHT, 7xxx alloy sheets are heated in a first aging step to a temperature ranging from 50° C. to 120° C. for a duration of 0.5 to 6 hrs (or from 70° C. to 120° C. for a duration of 1 to 6 hrs), and the alloy sheets are heated in a second aging step to temperatures of 150° C. to 175° C. for a duration of 1 to 6 hrs. Alternatively, following the first heating step, the alloy sheets are subjected to a paint bake temperature of 180° C. for 30 minutes. In still further embodiments, following SHT, 7xxx alloy sheets are heated in three consecutive aging steps with the first aging step at a temperature of 100° C. to 120° C. for a duration of 1 hr, the second at 150° C. for a duration of 1 hr, and the third at a temperature of 180° C. for 30 min.

It is to be understood that all recited temperatures and temperature ranges in this application can include ±5° C. at the upper limit and lower limit of the range. Accordingly, for example, the range of 70° C. to 120° C. recited above in the first aging step also includes 65° C. to 125° C., 70° C. to 125° C., 75° C. to 125° C., 65° C. to 120° C., 75° C. to 120° C., 65° C. to 115° C., 70° C. to 115° C. and 75° C. to 115° C.

Approximately two minutes were required to reach the recited temperatures with furnaces in the laboratory. Using this concept in a pre-aging step right after solution heat treatment (CASH) in an industrial setting means heating the sheet relatively fast as it passes through the pre-aging furnace. The heating time to the desired temperature in that case is faster and below one minute. However if the two step aging process will be employed separately on a coil, then it probably requires about 6 hrs. for the coil to heat up to the desired temperature depending on the configuration of the furnace and its initial set temperature.

Various 7xxx alloys may be employed in this process, including but not limited to 7075, 7010, 7040, 7050, 7055, 7150, 7085, 7016, 7020, 7021, 7022, 7029 and 7039. The 7075 alloy samples tested and presented in this application were all 2 mm gauge rolled sheet. The testing methods employed are known to one of ordinary skill in the art following ASTM B557-10: TYS, UTS, n, r, UE, Total Elongation, Stress-strain curves (http://www.astm.org/DATABASE.CART/HISTORICAL/B557-10.htm).

In some examples provided herein, the 7xxx alloys are heated from room temperature to a solution heat treatment (SHT) temperature of 480° C. in 50 seconds, held at 480° C. for 90 seconds then cooled to 450° C. and then rapidly cooled to room temperature at a cooling rate of more than 150° C. per second. Next, the first step aging occurs. The sheet is heated to a chosen temperature in about 2 min. Note, this 2 minute heating step applies to laboratory scale samples and heating on an industrial scale will require additional time as commonly known to one of ordinary skill in the art.

For single aging step embodiments, temperatures of 130° C. and 150° C. were tested for a duration of 1 or 5 hours.

For two aging step embodiments, first step temperatures of 70° C., 100° C., 110° C., 120° C. and 125° C. were tested. Most of these temperatures were tested for a duration of 1 or 6 hrs. In some embodiments, after the 1 or 6 hrs. duration for step one, samples were then heated to target temperatures of 150° C. or 175° C. and held for 1 or 6 hrs. duration. In other embodiments, after the 1 hr. duration or after the 6 hr. duration for step one, samples were then heated to a temperature of 180° C. for about 30 min as normally done for paint bake conditions in the automotive industry. Paint bake temperature conditions, as described herein, mean heating at a temperature of 180° C. for about 30 min.

For three aging step embodiments, first step temperatures of 100° C. and 120° C. were tested for a duration of 1 hr, followed by a second step temperature of 150° C. for 1 hr, followed by a third step temperature of 180° C. for 30 minutes.

One method of the present invention for achieving desired yield strength and elongation in an 7xxx aluminum alloy sheet generally comprises:

a) rapidly heating the sheet to a temperature of 450° C. to 510° C.;
b) maintaining the sheet at 450° C. to 510° C. for up to 20 minutes;
c) rapidly cooling the sheet to room temperature at more than 50° C. per second;
d) heating the sheet to a temperature between about 50° C. and 150° C.;
e) maintaining the sheet at the temperature between about 50° C. and 150° C. for a duration of about 0.5 to 6 hrs.;
f) heating the sheet to a temperature between about 150° C. and 200° C.; and,
g) maintaining the sheet at the temperature between about 150° C. and 200° C. for a duration of about 0.5 to 6 hrs.

In another embodiment of the present invention, the method for achieving desired yield strength and elongation in an 7xxx aluminum alloy sheet comprises:

a) rapidly heating the sheet to a temperature of about 450° C. to about 510° C.;
b) maintaining the sheet at 450° C. to 510° C. for up to 20 min;
c) rapidly cooling the sheet to room temperature at more than 50° C. per second;
d) heating the sheet to a temperature of from about 110° C. to about 125° C.;
e) maintaining the sheet at the temperature of from about 110° C. to about 125° C. for a duration of about 6 hrs.;
f) heating the sheet to a temperature of about 180° C.; and,
g) maintaining the sheet at the temperature about 180° C. for a duration of about 0.5 hrs.

In another embodiment of the present invention, the method for achieving desired yield strength and elongation in an 7xxx aluminum alloy sheet comprises:

a) rapidly heating the sheet to a temperature of about 450° C. to about 510° C.;
b) maintaining the sheet at 450° C. to 510° C. for up to 20 min;
c) rapidly cooling the sheet to room temperature at more than 50° C. per second;
d) heating the sheet to a temperature of from about 130° C. to about 150° C.;
e) maintaining the sheet at the temperature of from about 130° C. to about 150° C. for a duration of about 1-5 hrs.

In another embodiment of the present invention, the method for achieving desired yield strength and elongation in an 7xxx aluminum alloy sheet comprises:

a) rapidly heating the sheet to a temperature of about 450° C. to about 510° C.;
b) maintaining the sheet at 450° C. to 510° C. for up to 20 min;
c) rapidly cooling the sheet to room temperature at more than 50° C. per second;
d) heating the sheet to a temperature of from about 100° C. to about 120° C.;
e) maintaining the sheet at the temperature of from about 100° C. to about 120° C. for a duration of about 1 hr.;
f) heating the sheet to a temperature of about 150° C.;
g) maintaining the sheet at the temperature about 150° C. for a duration of about 1 hr.;
h) heating the sheet to a temperature of about 180° C.; and,
g) maintaining the sheet at the temperature about 180° C. for a duration of about 0.5 hrs.

Ingots with the following composition were cast 5.68 wt. % Zn, 2.45 wt. % Mg, 1.63 wt. % Cu, 0.21 wt. % Cr, 0.08 wt. % Si, 0.12 wt. % Fe, and 0.04 wt. % Mn, remainder Al. Two ingots per drop were cast. The ingot sizes were as follows: 380 mm×1650 mm×4100 mm. The ingots were scalped with the depth of 2×10 mm. The ingots were homogenized in the following two stage process. They were first heated up to 465° C. in 8 hrs., then they were soaked at 480° C. for 10 hrs.

The rolling processes were performed as follows on an industrial scale. The ingot was heated to 420° C.+/−10° C. (metal temperature (MT)) for a duration of 0 to 6 hr. Successive hot rolling was performed in the temperature range of 350-400° C. The exit gauge of the hot rolled sheet was 10.5 mm. Cold rolling then followed in four passes from 10.5 mm to 6.3 mm to 4 mm to 2.9 mm and finally to 2 mm as the final gauge without performing inter-annealing in between. The two coils from the two ingots showed identical properties. Therefore the tests were performed on one of the sheets. Tensile samples were taken from this 2 mm sheet rolled to conduct solution heat treatment and aging practices that are presented herein.

AA7045 alloys were subjected to a single aging step following solution heat treatment at 470° C. for 20 min and water quench. The single aging step is at a temperature ranging from 130° C. to 150° C. for a duration of 1 to 5 hrs. In embodiments, yield strengths of at least 400 MPa were attained. In embodiments yield strengths of at least 470 were attained. In embodiments, elongation of at least 5% were attained. Table 1 shows the effect of the single aging step on yield strength (Y.S. in MPa), ultimate tensile strength (Rm in MPa), uniform elongation (Ag in %), and total elongation (A80 in %).

TABLE 1

| | T41 + 130° C. 1 hr | T41 + 130° C. 5 hr | T41 + 130° C. 12 hr | T41 + 130° C. 24 hr | T41 + 150° C. 1 hr | T41 + 150° C. 5 hr | T41 + 150° C. 12 hr | T41 + 150° C. 24 hr |
|---|---|---|---|---|---|---|---|---|
| Y.S. | 412.9 | 485.1 | 479.9 | 494 | 470 | 499.5 | 473.1 | 468.5 |
| Rm | 512.6 | 549.5 | 528.3 | 537.2 | 532.8 | 544.5 | 524.7 | 525.5 |
| Ag | 15.5 | 10.8 | 9 | 8.2 | 10.2 | 8.6 | 7.7 | 7.7 |
| A80 | 18.3 | 13.6 | 11.4 | 10.7 | 12.9 | 12.1 | 10.1 | 10.3 |
| | T41 + 95° C. - 1 1 hr | T41 + 95° C. - 5 1 hr | T41 + 95° C. 12 hr | T41 + 95° C. 24 hr | T41 + 220° C. 1 hr | T41 + 220° C. 5 hr | T41 + 220° C. 12 hr | T41 + 220° C. 24 hr |
| Y.S. | 349.4 | 392.7 | 420 | 447 | 358.9 | 256 | 238.7 | 194.3 |
| Rm | 493 | 520.2 | 535.3 | 551.6 | 444 | 363.4 | 371.6 | 311.4 |
| Ag | 18.6 | 17.6 | 16.3 | 15.4 | 8.4 | 8.4 | 9.2 | 9.3 |
| A80 | 19.7 | 19.9 | 18.8 | 18.5 | 11.3 | 10.7 | 10.9 | 11.3 |

AA7022 alloys were subjected to a single aging step following solution heat treatment at 470° C. for 20 min and water quench. The single aging step is at a temperature ranging from 130° C. to 150° C. for a duration of 1 to 5 hrs (durations of 12 and 24 hours are shown for comparison). In embodiments, yield strengths of at least 400 MPa were attained. In embodiments yield strengths of at least 470 were attained. In embodiments, elongation of at least 5% were attained. Table 1 shows the effect of the single aging step on yield strength (Y.S. in MPa), ultimate tensile strength (Rm in MPa), uniform elongation (Ag in %), and total elongation (A80 in %).

TABLE 2

| | T41 + 130° C. 1 hr | T41 + 130° C. 5 hr | T41 + 130° C. 12 hr | T41 + 130° C. 24 hr | T41 + 150° C. 1 hr | T41 + 150° C. 5 hr | T41 + 150° C. 12 hr | T41 + 150° C. 24 hr |
|---|---|---|---|---|---|---|---|---|
| Y.S. | 358.7 | 441.6 | 482 | 493.1 | 407.9 | 464.5 | 473.1 | 466.6 |
| Rm | 468.9 | 504.9 | 530.1 | 537.2 | 482 | 514.6 | 524.8 | 523.5 |
| Ag | 15 | 11.4 | 8.6 | 8 | 10.5 | 7.8 | 7.6 | 7.8 |
| A80 | 17.2 | 13.2 | 10.9 | 10.4 | 12.9 | 10.2 | 10.1 | 10.5 |
| | T41 + 95° C. - 1 1 hr | T41 + 95° C. - 5 1 hr | T41 + 95° C. 12 hr | T41 + 95° C. 24 hr | T41 + 220° C. 1 hr | T41 + 220° C. 5 hr | T41 + 220° C. 12 hr | T41 + 220° C. 24 hr |
| Y.S. | 312.3 | 346.5 | 378.3 | 407 | 349.7 | 283.1 | 240 | 194.8 |
| Rm | 461.9 | 477.2 | 498.5 | 514.8 | 457.3 | 409.9 | 374 | 334.6 |
| Ag | 18.6 | 19.7 | 16.3 | 16.2 | 86 | 8.4 | 9.2 | 9.8 |
| A80 | 19.2 | 21 | 17.6 | 17.5 | 11.1 | 11.2 | 10.7 | 11.6 |

FIG. 1 shows the effect of a single heating step followed by natural aging at room temperature on yield strength (Y.S. in MPa) and elongation (EL %). T6 is a heat treatment process after solution heat treatment that is performed for 24 hrs at 125° C. After solution heat treatment and quench the condition is called W-temper. The delay between quench and the subsequent T6 heat treatment is called "natural aging" period. FIG. 2 shows the double aging response on yield strength (Y.S. in MPa) and elongation (EL %) after a two-step heating at defined temperatures and durations.

In one experiment, following the first step heating to 120° C. for 1 hr., samples were cooled to room temperature after which a second heating step at 150° C. or 175° C. occurred for durations of 6 or 1 hr., respectively. This resulted in a final yield strength of 510 MPa and 479 MPa, respectively, with elongation values of 13.4% or 12.8% respectively. Accordingly, there appears to be no discernible effect of cooling to room temperature after the first heating step before beginning heating for the second step.

Thus it appears that moving from the first-step heating conditions directly to the second step heating conditions, at a particular target temperature for 1 hr. or 6 hrs., or some duration between, is adequate to achieve the desired strength and elongation values (FIGS. 2-6).

Results also demonstrate that moving from the first step heating conditions directly to the paint bake temperature of 180° C. for 30 min is also adequate to achieve the desired strength and elongation values (FIGS. 7-11).

In yet another embodiment, a first step of 100° C. for 1 hr. was followed by a second step 150° for 1 hr. and finally paint bake conditions of 180° for 30 min which resulted in a strength of 496 MPa with an elongation value of 12.6% (FIG. 13). In yet another embodiment, a first step of 120° C. for 1 hr. was followed by a second step 150° for 1 hr. and finally paint bake conditions of 180° for 30 min which resulted in a strength of 493 MPa with an elongation value of 12.6% (FIG. 14).

In one embodiment, by combining pre-aging and a paint baking cycle, strength levels for 7xxx alloys above 400 MPa can be attained. In another embodiment, by combining pre-aging and a paint baking cycle, strength levels for 7xxx alloys above 470 MPa can be attained. In another embodiment, by combining pre-aging and a paint baking cycle, strength levels for 7xxx alloys above 500 MPa can be attained.

In one embodiment, a two-step aging process with a short first step aging at a lower temperature, followed by a second step aging at a higher temperature results in yield strength above 500 MPa In another embodiment, at a low temperature first step aging, more time is needed to achieve high strength in the second step. In one embodiment, by combining pre-aging and a paint baking cycle, strength levels for 7xxx alloys above 470 MPa or 500 MPa can be attained. For example, a first step of 1 hr. at 70° C. requires a second step of 6 hrs. at 175° C. In contrast, a first step aging at 100° C. or 120° C. only required a 1 hr. second step aging at 175° C. A longer duration for the first step did not change the strength significantly.

In another embodiment, at 100° C. or more for the first step aging, it is possible to attain strength levels above 500 MPa if one of the two steps is performed for a longer duration (e.g. 6 hrs. at 120° C. then 1 hr. at 175° C., or 1 hr. at 120° C. then 6 hrs. at 150° C., or 6 hrs. at 100° C. then 1 hr. at 175° C., or 1 hr. at 100° C. then 6 hrs. at 150° C.).

In one embodiment, if the first step aging is performed at 100° C. or more, a longer duration for the second step aging at 175° C. may reduce the strength due to over aging.

Figure 3:
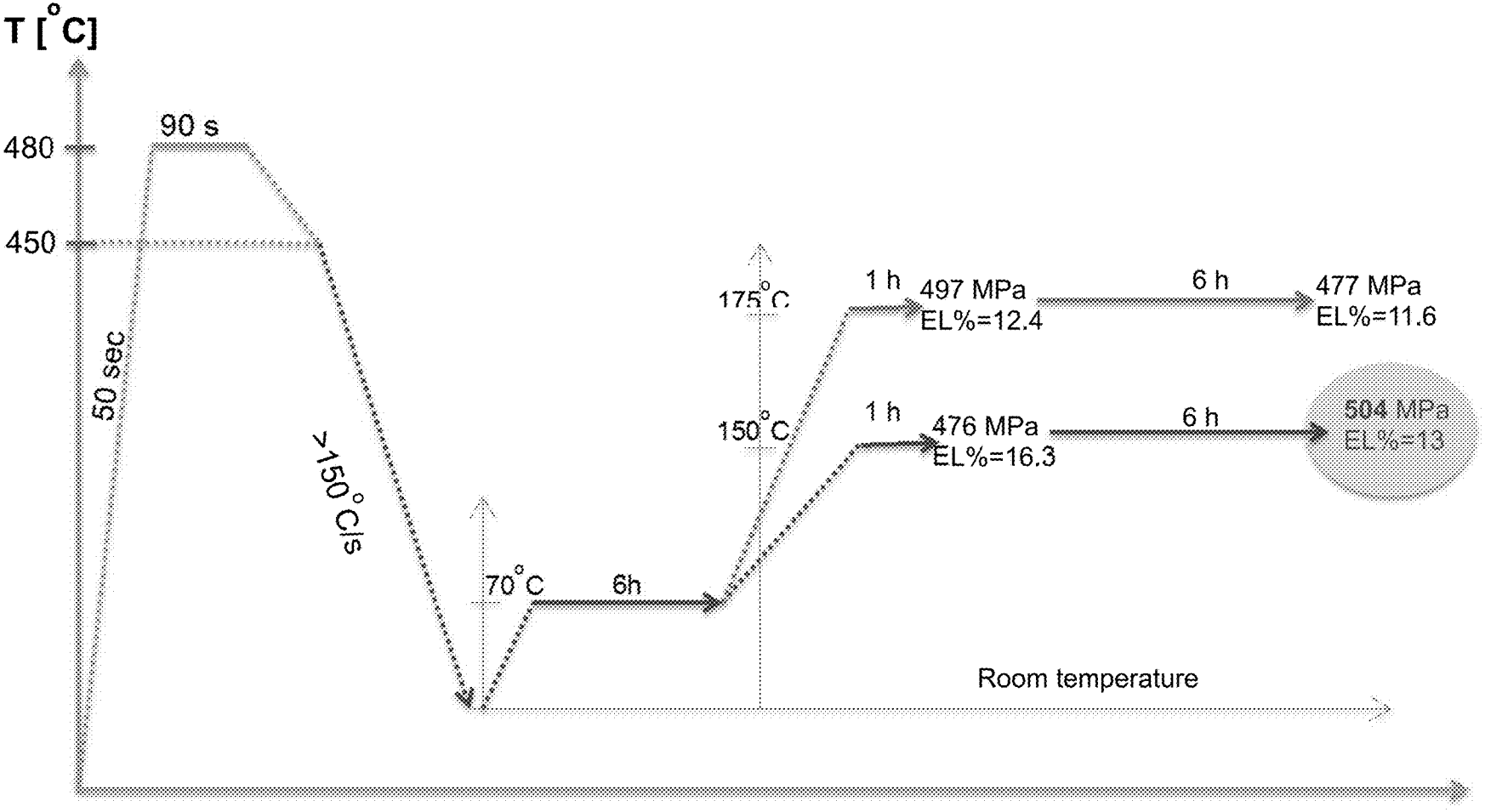
FIG. 3 is a schematic representation of a two-step aging process with the first heating step of 70° C. for 6 hrs. followed by a second heating step of 150° C. for 1 hr. or 6 hrs. or 175° C. for 1 hr. or 6 hrs. Effects on yield strength and elongation are shown.
Figure 4:
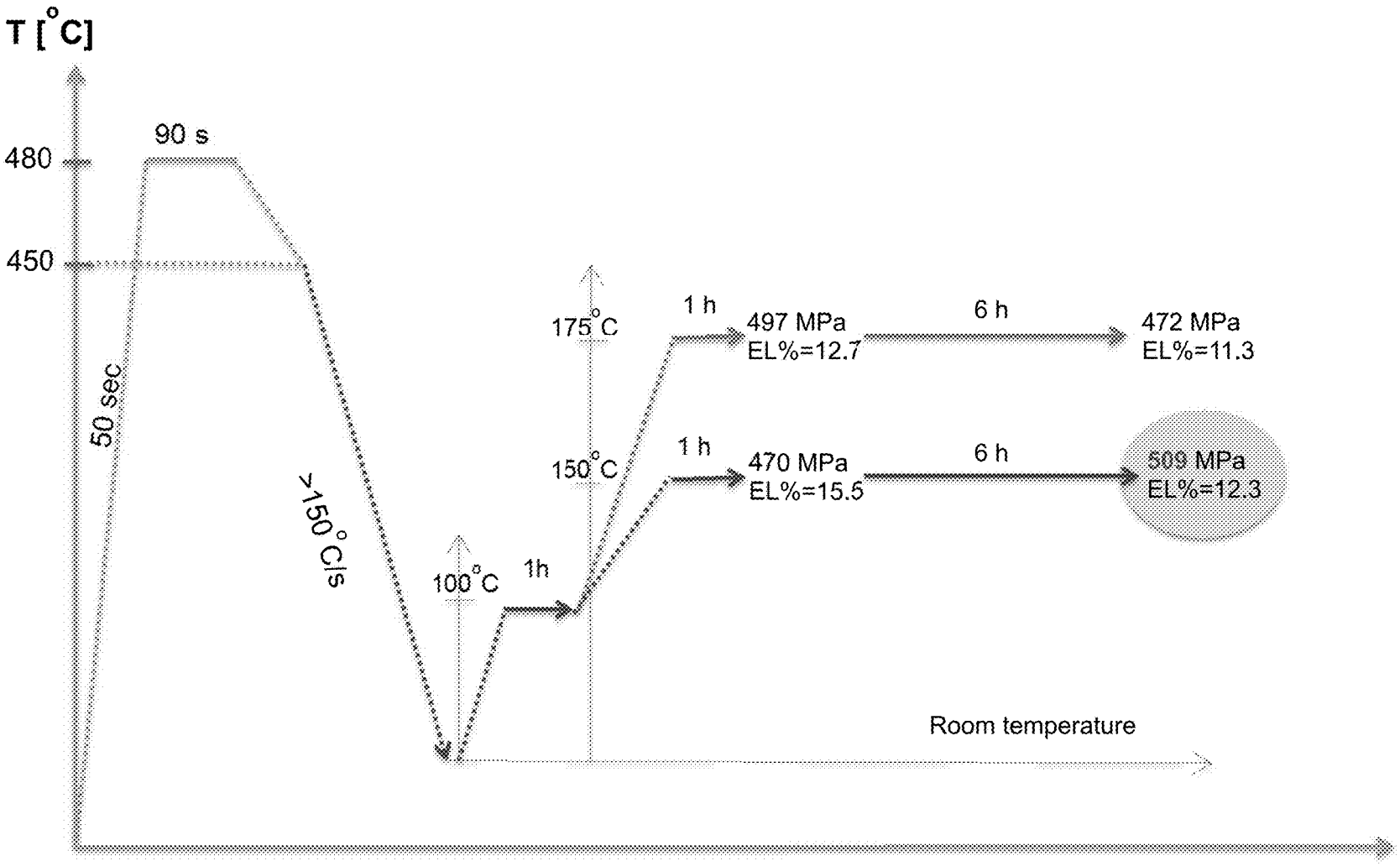
FIG. 4 is a schematic representation of a two-step aging process with the first heating step of 100° C. for 1 hr. followed by a second heating step of 150° C. for 1 hr. or 6 hrs. or 175° C. for 1 hr. or 6 hrs. Effects on yield strength and elongation are shown.
Figure 5:
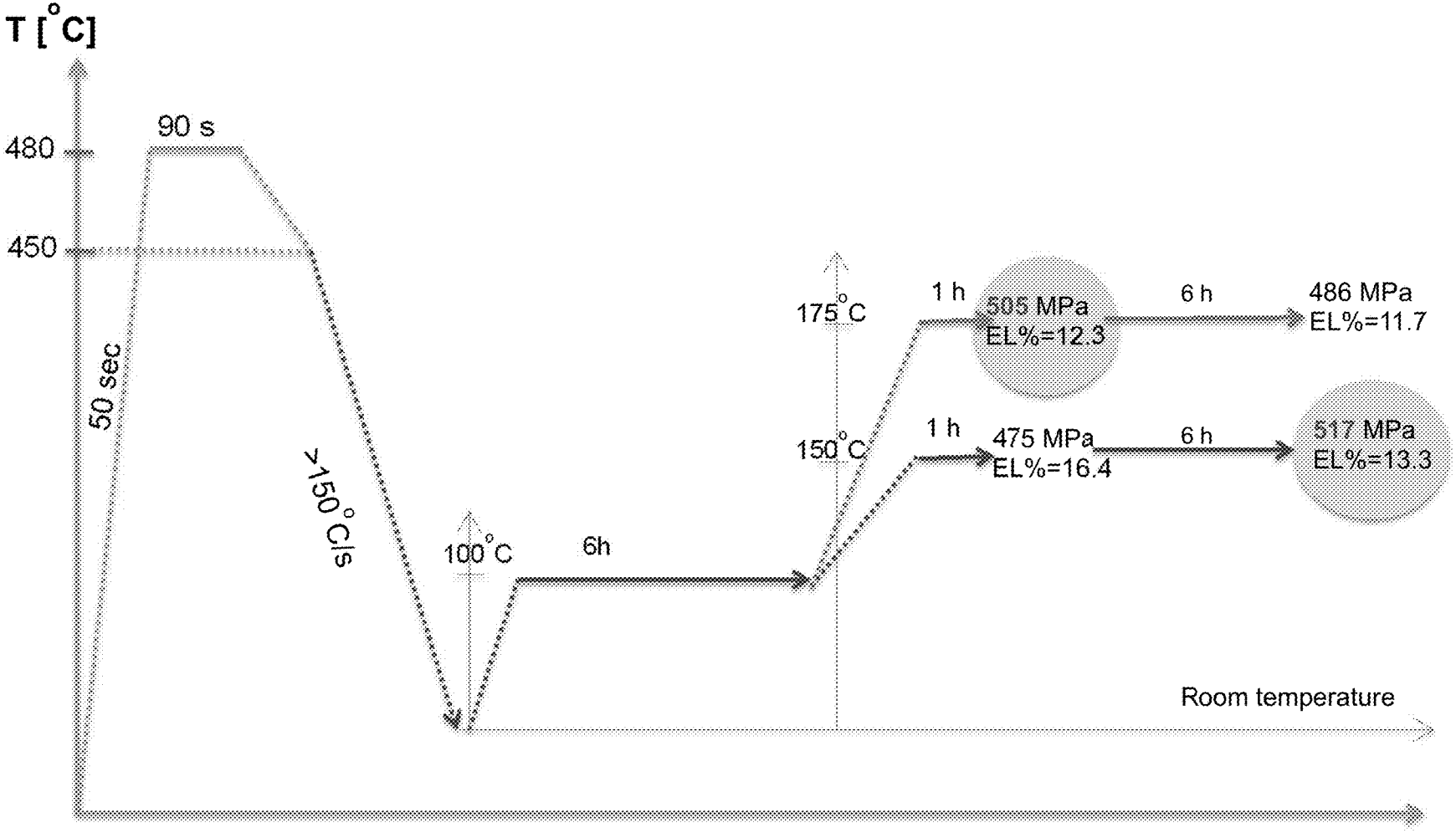
FIG. 5 is a schematic representation of a two-step aging process with the first heating step of 100° C. for 6 hrs.

The highest strength (yield strength of 517 MPa) was achieved by a first step of 6 hrs. aging at 100° C. and a second step of 6 hr. at 150° C. (FIG. 5). Reducing the time for the first step aging to 1 hr. followed by a second step of 6 hrs. at 150° C. produced a yield strength of 509 MPa (FIG. 4).

In yet another embodiment, strength levels close to 500 MPa can be attained by following the two step short aging process with the paint bake treatment of 180° C. for about 30 min (a 3 step process, FIGS. 13, 14).

The first two weeks of natural aging showed the most effect on the strength. Natural aging, for a week and longer, appeared to reduce the peak strength level slightly (by less than 10 MPa).

Pre-aging at 70° C., 100° C., 110° C. and 125° C. results in the stabilization of natural aging response. This effect is more pronounced at longer durations of pre-aging, i.e. 6 hrs. (FIG. 1).

Pre-aging at 70° C., 100° C. and 125° C. for 6 hrs. resulted in T6 strength levels above 520 MPa with a total elongation of about 14% (FIG. 1).

Pre-aging for 6 hrs. at 110° C. and 125° C., which is quite practical in the current Continuous Annealing Solution Heat (CASH) line configuration, increased the strength level of the natural aging to above 450 MPa.

In another embodiment, conducting a paint-bake for 30 min at 180° C. after 6 hrs. of pre-aging at 110° C. or 6 hrs. at 125° C. produced a strength level above 500 MPa (FIGS. 10, 11). A 110° C. pre-aging temperature appears to produce very good results. The process can be incorporated in the CASH line practice by setting the re-heating furnace temperature about 10° C. higher than this value providing that the further coil cooling would take about 8 hrs. This process essentially eliminates a separate long artificial aging cycle in a furnace needed to produce a T6 or T7 temper sheet in coil form. Typical industrial scale artificial aging of coils takes significant amounts of time—both for heating (up to 12 hours) and conventional aging times (up to 24 hours) at a temperature in the range of 120° C.-125° C. for achieving T6 strength levels. The temperature of the coils needs to be accurate and controlling the temperature of individual coils in a multi-coil aging furnace can be challenging. This embodiment of present invention allows for producing coils of desired temper and properties by choosing the pre-aging or re-heating practice and shortening the flow-path, and also saves time, energy and money.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

Example 1

A one-step aging process was tested using AA7075 and AA7022 alloy sheets in various temperatures and durations of heating. The results are shown in Tables 1 and 2. High strength levels and desired elongation percentages were achieved much faster than conventional techniques, which can take 24 hours or more.

Example 2

A two-step aging process was tested using AA7075 alloy sheet in various temperatures and duration of heating. The results are shown in FIGS. 2 through 6. High-strength levels and desired elongation percentages were achieved much faster than conventional techniques, which can take 24 hours or more.

Example 3

A two-step aging process was tested using AA7075 alloy sheet in various first step temperatures and durations of heating followed by a second step at 180° C. for 30 minutes which is the paint break condition. The results are shown in FIGS. 2 and 7 through 11. High-strength levels and desired elongation percentages were achieved much faster than conventional techniques, which can take 24 hours or more.

Example 4

In this example, a first heating step of 125° C. for 24 hrs. (the T6 condition) was followed by a second heating step of 180° C. for 30 min which is a conventional paint bake condition. The second heating step occurred following the first step or 3 hrs. later. The results on strength and elongation were similar and there was no effect of a three-hour delay before the paint bake condition which implies that such a delay does not have any effect on the paint back properties. The result is shown in FIG. 12. It is notable that when the results presented in FIG. 12 are compared to the results in FIGS. 3 through 11, much shorter aging times can be employed to attain the desired levels of strength and ductility, thereby saving energy, expense and manufacturing time and storage hence significantly increasing the productivity.

Example 5

A three step aging approach was employed in this example. The third step constituted a paint bake condition following exposure to one hour at 100° C. or 120° C. followed by one hour at 150° C. The results demonstrate that using three heating steps of a total duration of 2.5 hrs., very high levels of strength and ductility are attained. The results are shown in FIGS. 13 and 14.

Example 6

This example shows a one-step aging process with the first heating step of 110° C. for 6 hrs., followed by air cooling to room temperature (- - - - lines) or cooling at a rate of 3° C. per hr. to a target temperature of 50° C. (--•--•-- lines). The results are shown in FIGS. 15 and 16 and demonstrate that this single heating step can produce high strength levels undesirable elongation values with superior results obtained at 125° C. for six hours as shown in FIG. 16. Very high-strength levels were obtained following the gradual cooling to 50° C. at a rate of 3° C. per hour which is similar to a coil cooling process in auto sheet manufacturing of aluminum alloys.

All patents, publications and abstracts cited above are incorporated herein by reference in their entirety. Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the present invention as defined in the following claims.

The invention claimed is:

1. A method for achieving a yield strength and elongation in an 7xxx aluminum alloy sheet comprising:

a) heating the sheet to a temperature of 450° C. to 510° C.;
b) maintaining the sheet at the temperature of 450° C. to 510° C. for up to 20 minutes;
c) cooling the sheet to room temperature at more than 50° C. per second;
d) heating the sheet to a temperature between about 50° C. and 150° C.;
e) maintaining the sheet at the temperature between about 50° C. and 150° C. for a duration of about 1 hour
f) heating the sheet at a temperature between about 150° C. and 200° C.; and,
g) maintaining the sheet at the temperature between about 150° C. and 200° C. for a duration of about 0.5 to 6 hrs.

2. The method of claim 1, further comprising cooling the sheet to room temperature after step g.

3. The method of claim 2, further comprising measuring the yield strength and elongation of the sheet to determine if the sheet attains the a yield strength and elongation.

4. The method of claim 3, wherein the yield strength is at least 400 MPa.

5. The method of claim 3, wherein the elongation is at least 5%.

6. The method of claim 1, wherein the 7xxx alloy is 7075, 7010, 7040, 7050, 7055, 7150, 7085, 7016, 7020, 7021, 7022, 7029, or 7039.

7. The method of claim 1, wherein heating the sheet to a temperature between about 50° C. and 150° C. comprises heating the sheet to a temperature between about 70° C. and about 120° C., and wherein maintaining the sheet at the temperature between about 50° C. and 150° C. for a duration of about 0.5 hrs to 6 hrs comprises maintaining the sheet at the temperature between about 70° C. and about 120° C. for about 1 to 6 hrs.

8. The method of claim 7, wherein heating the sheet at a temperature between about 150° C. and 200° C. comprises heating the sheet to a temperature between about 150° C. and 175° C., and wherein maintaining the sheet at the temperature between about 150° C. and 200° C. for a duration of about 0.5 to 6 hrs comprises maintaining the sheet at the temperature between about 150° C. and 175° C. for a duration of 1 to 6 hours.

9. The method of claim 7, wherein heating the sheet at a temperature between about 150° C. and 200° C. comprises heating the sheet to a temperature of about 180° C., and wherein maintaining the sheet at the temperature between about 150° C. and 200° C. for a duration of about 0.5 to 6 hrs comprises maintaining the sheet at the temperature of about 180° C. for a duration of about 0.5 hrs.

10. The method of claim 1, wherein heating the sheet to a temperature between about 50° C. and 150° C. comprises heating the sheet to a temperature between about 100° C. and 120° C., and wherein maintaining the sheet at a temperature between about 50° C. and 150° C. comprises maintaining the sheet at the temperature between about 100° C. and 120° C. for a duration of about 1 hour.

11. The method of claim 10, wherein heating the sheet at a temperature between about 150° C. and 200° C. comprises heating the sheet to a temperature of about 150° C., and wherein maintaining the sheet at the temperature between about 150° C. and 200° C. for a duration of about 0.5 to 6 hrs comprises maintaining the sheet at a temperature of about 150° C. for a duration of about 1 hour.

12. The method of claim 11, further comprising heating the sheet to a temperature of about 180° C. and maintaining the sheet at the temperature of about 180° C. for a duration of about 0.5 hr.

13. A method for achieving a yield strength and elongation in an 7xxx aluminum alloy sheet comprising:

a) heating the sheet to a temperature of 450° C. to 510° C.;
b) maintaining the sheet at the temperature of 450° C. to 510° C. for up to 20 minutes;
c) cooling the sheet to room temperature at more than 50° C. per second;
d) heating the sheet to a temperature of from about 130° C. to about 150° C.;
e) maintaining the sheet at the temperature of from about 130° C. to about 150° C. for a duration of about 1 to 5 hrs
f) heating the sheet at a temperature between about 150° C. and 200° C.; and,
g) maintaining the sheet at the temperature between about 150° C. and 200° C. for a duration of about 0.5 to 6 hrs.

14. The method of claim 13, further comprising measuring the yield strength and elongation of the sheet to determine if the sheet attains the a yield strength and elongation.

15. The method of claim 14, wherein the yield strength is at least 400 MPa.

16. The method of claim 14, wherein the elongation is at least 5%.

17. The method of claim 13, wherein the 7xxx alloy is 7075, 7010, 7040, 7050, 7055, 7150, 7085, 7016, 7020, 7021, 7022, 7029, or 7039.

18. The method of claim 1, further comprising forming the alloy into a finished product, semi-finished products, formed part, plate or sheet.

* * * * *